US011278076B2

(12) United States Patent
Suddaby

(10) Patent No.: US 11,278,076 B2
(45) **Date of Patent: *Mar. 22, 2022**

(54) PROTECTIVE HELMET WITH ENERGY STORAGE MECHANISM

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 722 days.

This patent is subject to a terminal disclaimer.

(21) Appl. No.: 15/883,363

(22) Filed: Jan. 30, 2018

(65) Prior Publication Data

US 2018/0160760 A1 Jun. 14, 2018

Related U.S. Application Data

(63) Continuation-in-part of application No. 15/401,257, filed on Jan. 9, 2017, now Pat. No. 9,980,531, which (Continued)

(51) Int. Cl.
*A42B 3/06* (2006.01)
*A42B 3/04* (2006.01)
(Continued)

(52) U.S. Cl.
CPC ..... *A42B 3/065* (2013.01); *A42B 3/046* (2013.01); *A42B 3/064* (2013.01); *A42B 3/067* (2013.01); *A42B 3/124* (2013.01); *A42B 3/30* (2013.01)

(58) Field of Classification Search
CPC ..... A42B 3/121; A42B 3/064; A42B 3/124; A42B 3/322; A42B 3/326; A42B 3/06; A42B 3/065; A42B 3/067; F41H 1/04
See application file for complete search history.

(56) References Cited

U.S. PATENT DOCUMENTS 2,194,903 A 3/1940 Holstein
2,861,272 A 11/1958 Stuart et al.
(Continued)

FOREIGN PATENT DOCUMENTS

CN 201094314 8/2008
DE 19544375 3/1997
(Continued)

OTHER PUBLICATIONS

"Window." Merriam-Webster, Merriam-Webster, www.merriam-webster.com/dictionary/window.*

*Primary Examiner* — Sally Haden
(74) *Attorney, Agent, or Firm* — Simpson & Simpson, PLLC; Michael Nicholas Vranjes

(57) ABSTRACT

A protective helmet having multiple protective zones, including an inner shell having a first inner surface and a first outer surface, an outer shell having a second inner surface, a second outer surface, and at least one window defined by said outer shell, said outer shell functionally attached to said inner shell, an elastomeric zone between said first outer surface and said second inner surface, a plurality of sinusoidal springs positioned in said elastomeric zone, each of the plurality of sinusoidal springs including a first end, and a second end, a force indicator tab in operative contact with said second end of at least one of said plurality of sinusoidal springs, wherein said force indicator tab is displaced in said at least one window by said second end when said helmet is impacted with sufficient force, and a transmission device.

20 Claims, 15 Drawing Sheets

Related U.S. Application Data is a continuation-in-part of application No. 14/615,011, filed on Feb. 5, 2015, now Pat. No. 10,517,347, which is a continuation-in-part of application No. 13/841,076, filed on Mar. 15, 2013, now Pat. No. 9,795,178, which is a continuation-in-part of application No. 13/412,782, filed on Mar. 6, 2012, now abandoned.

(51) Int. Cl.
*A42B 3/12* (2006.01)
*A42B 3/30* (2006.01)

(56) References Cited

U.S. PATENT DOCUMENTS

| | | | |
|---|---|---|---|
| 3,089,144 | A | 5/1963 | Cherup |
| 3,107,356 | A | 10/1963 | Pestronk et al. |
| 3,167,069 | A | 1/1965 | Lobelle |
| 3,600,714 | A | 8/1971 | Cade et al. |
| 3,616,463 | A | 11/1971 | Theodore et al. |
| 3,668,704 | A | 6/1972 | Conrov et al. |
| 3,872,511 | A | 3/1975 | Nichols |
| 3,875,275 | A | 4/1975 | Lemelson |
| 3,946,441 | A | 3/1976 | Johnson |
| 4,023,209 | A | 5/1977 | Frieder, Jr. et al. |
| 4,075,717 | A | 2/1978 | Lemelson |
| 4,124,904 | A | 11/1978 | Matthes |
| 4,211,220 | A | 7/1980 | O'Neill |
| 4,307,471 | A | 12/1981 | Lovell |
| 4,345,338 | A | 8/1982 | Frieder, Jr. et al. |
| 4,566,137 | A | 1/1986 | Gooding |
| 4,586,200 | A | 5/1986 | Poon |
| 4,903,346 | A | 2/1990 | Reddemann et al. |
| 5,003,973 | A | 4/1991 | Ford et al. |
| 5,101,517 | A | 4/1992 | Douglas |
| 5,181,279 | A | 1/1993 | Ross |
| 5,204,998 | A | 4/1993 | Liu |
| 5,263,202 | A | 11/1993 | Siberell |
| 5,319,808 | A | 6/1994 | Bishop et al. |
| 5,496,066 | A | 3/1996 | Hoffmann et al. |
| 5,815,846 | A | 10/1998 | Calonge |
| 5,950,244 | A | 9/1999 | Fournier et al. |
| 5,956,777 | A | 9/1999 | Popovich |
| 6,014,769 | A | 1/2000 | Baudou et al. |
| 6,138,283 | A | 10/2000 | Kress |
| 6,378,140 | B1 | 4/2002 | Abraham et al. |
| 6,604,246 | B1 | 8/2003 | Obreja |
| 6,658,671 | B1 | 12/2003 | Von Holst et al. |
| 6,817,039 | B1 | 11/2004 | Grilliot et al. |
| 7,774,866 | B2 | 8/2010 | Ferrara |
| 7,895,681 | B2 | 3/2011 | Ferrara |
| 7,941,873 | B2 | 5/2011 | Nagely et al. |
| 8,117,676 | B1 | 2/2012 | Cardoso |
| 8,176,574 | B2 | 5/2012 | Bryant et al. |
| 8,181,281 | B2 | 5/2012 | Nagely et al. |
| 8,860,570 | B2 | 10/2014 | Thomas et al. |
| 2001/0032351 | A1 | 10/2001 | Nakayama et al. |
| 2002/0073994 | A1 | 6/2002 | Patel |
| 2003/0217483 | A1 | 11/2003 | Abraham |
| 2007/0190292 | A1 | 8/2007 | Ferrara |
| 2008/0229488 | A1 | 9/2008 | Kim |
| 2008/0256686 | A1 | 10/2008 | Ferrara |
| 2010/0000009 | A1 | 1/2010 | Morgan |
| 2010/0023135 | A1 | 1/2010 | Rubie et al. |
| 2011/0072548 | A1 | 3/2011 | Hersick et al. |
| 2012/0198604 | A1 | 8/2012 | Weber et al. |
| 2012/0210490 | A1 | 8/2012 | Harty |
| 2012/0233745 | A1 | 9/2012 | Veazie |
| 2012/0297526 | A1 | 11/2012 | Leon |
| 2013/0061371 | A1 | 3/2013 | Phipps et al. |
| 2013/0167289 | A1 | 7/2013 | Rensink et al. |
| 2014/0173810 | A1 | 6/2014 | Suddaby |
| 2014/0215694 | A1 | 8/2014 | Grice |
| 2015/0143617 | A1 | 5/2015 | Suddaby |
| 2015/0208751 | A1 | 7/2015 | Day |
| 2016/0029730 | A1 | 2/2016 | Day |
| 2016/0128414 | A1 | 5/2016 | Gotti |
| 2016/0157545 | A1 | 6/2016 | Bowman |
| 2017/0112220 | A1 | 4/2017 | Suddaby |

FOREIGN PATENT DOCUMENTS

| | | |
|---|---|---|
| EP | 0048442 | 3/1982 |
| EP | 1142495 | 10/2001 |
| JP | 2001295129 | 10/2001 |
| WO | 8605369 | 9/1986 |
| WO | 2003015555 | 2/2003 |
| WO | 2010-151631 | 12/2010 |
| WO | 2011090381 | 7/2011 |
| WO | WO2018/129447 | 7/2018 |

* cited by examiner

PROTECTIVE HELMET WITH ENERGY STORAGE MECHANISM

CROSS-REFERENCE TO RELATED APPLICATIONS

This application is filed under 35 U.S.C. § 120 as a continuation-in-part of U.S. patent application Ser. No. 15/401,257, filed on Jan. 9, 2017, which application is a continuation-in-part of U.S. patent application Ser. No. 14/615,011, filed Feb. 5, 2015, which application is a continuation-in-part of U.S. patent application Ser. No. 13/841,076, filed Mar. 15, 2013, now U.S. Pat. No. 9,795,178, issued Oct. 24, 2017, which application is a continuation-in-part of U.S. patent application Ser. No. 13/412,782, filed Mar. 6, 2012, which applications are hereby incorporated by reference in their entireties.

FIELD

The invention relates generally to a protective helmet, and, more particularly, to a protective helmet having an energy storage mechanism which absorbs linear and rotational forces and slowly releases such forces.

BACKGROUND

The human brain is an exceedingly delicate structure protected by a series of envelopes to protect it from injury. The innermost layer, the pia mater, covers the surface of the brain. The arachnoid layer, adjacent to the pia mater, is a spidery web-like membrane that acts like a waterproof membrane. Finally, the dura mater, a tough leather-like layer, covers the arachnoid layer and adheres to the bones of the skull.

While this structure protects against penetrating trauma, the softer inner layers absorb only a small amount of energy before linear forces applied to the head are transmitted to the brain. When an object strikes a human head, both the object and the human head are moving independently and often in different angles thus, angular forces, as well as linear forces, are almost always involved in head injuries. Many surgeons in the field believe the angular or rotational forces applied to the brain are more hazardous than direct linear forces due to the twisting or shear forces they apply to the white matter tracts and the brain stem.

One type of brain injury that occurs frequently is the mild traumatic brain injury (MTBI), more commonly known as a concussion. Such injury occurs in many settings, such as, construction worksites, manufacturing sites, and athletic endeavors and is particularly problematic in contact sports. While at one time a concussion was viewed as a trivial and reversible brain injury, it has become apparent that repetitive concussions, even without loss of consciousness, are serious deleterious events that contribute to debilitating irreversible diseases, such as dementia and neuro-degenerative diseases including Parkinson's disease, chronic traumatic encephalopathy (CTE), and dementia pugilistica.

Thus, there is a long-felt need for a protective helmet having an energy storage mechanism that absorbs linear and rotational forces and slowly releases such forces.

SUMMARY

According to aspects illustrated herein, there is provided a protective helmet having multiple protective zones, comprising an inner shell having a first inner surface and a first outer surface, an outer shell having a second inner surface, a second outer surface, and at least one window defined by said outer shell, said outer shell functionally attached to said inner shell, an elastomeric zone between said first outer surface and said second inner surface, a plurality of sinusoidal springs positioned in said elastomeric zone, each of the plurality of sinusoidal springs comprising a first end, and a second end, a force indicator tab in operative contact with said second end of at least one of said plurality of sinusoidal springs, wherein said force indicator tab is displaced in said at least one window by said second end when said helmet is impacted with sufficient force, and a transmission device.

According to aspects illustrated herein, there is provided a protective helmet having multiple protective zones, comprising an inner shell having a first inner surface and a first outer surface, an outer shell having a second inner surface and a second outer surface, said outer shell functionally attached to said inner shell, an elastomeric zone between said first outer surface and said second inner surface, a plurality of sinusoidal springs positioned in said elastomeric zone, each of the plurality of sinusoidal springs comprising a first end and a second end, and a transmission device, including a sensor arranged to determine the location of the second end, a transmitter arranged to transmit a signal indicating the location to a remote receiver, and a power source.

According to aspects illustrated herein, there is provided a protective helmet having multiple protective zones, comprising an inner shell having a first inner surface and a first outer surface, an outer shell having a second inner surface, a second outer surface, and at least one window defined by said outer shell, said outer shell functionally attached to said inner shell, an elastomeric zone between said first outer surface and said second inner surface, a plurality of sinusoidal springs positioned in said elastomeric zone, each of the plurality of sinusoidal springs comprising a first end and a second end, a plurality of piston devices arranged between the inner and outer shells, wherein each of said plurality of piston devices comprises a first component connected to the second end and a second component, and a force indicator tab in operative contact with said second end of at least one of said plurality of sinusoidal springs, wherein said force indicator tab is moved to said at least one window by said second end when said helmet is impacted with sufficient force, and a transmission device.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF EMBODIMENTS

Figure 1:
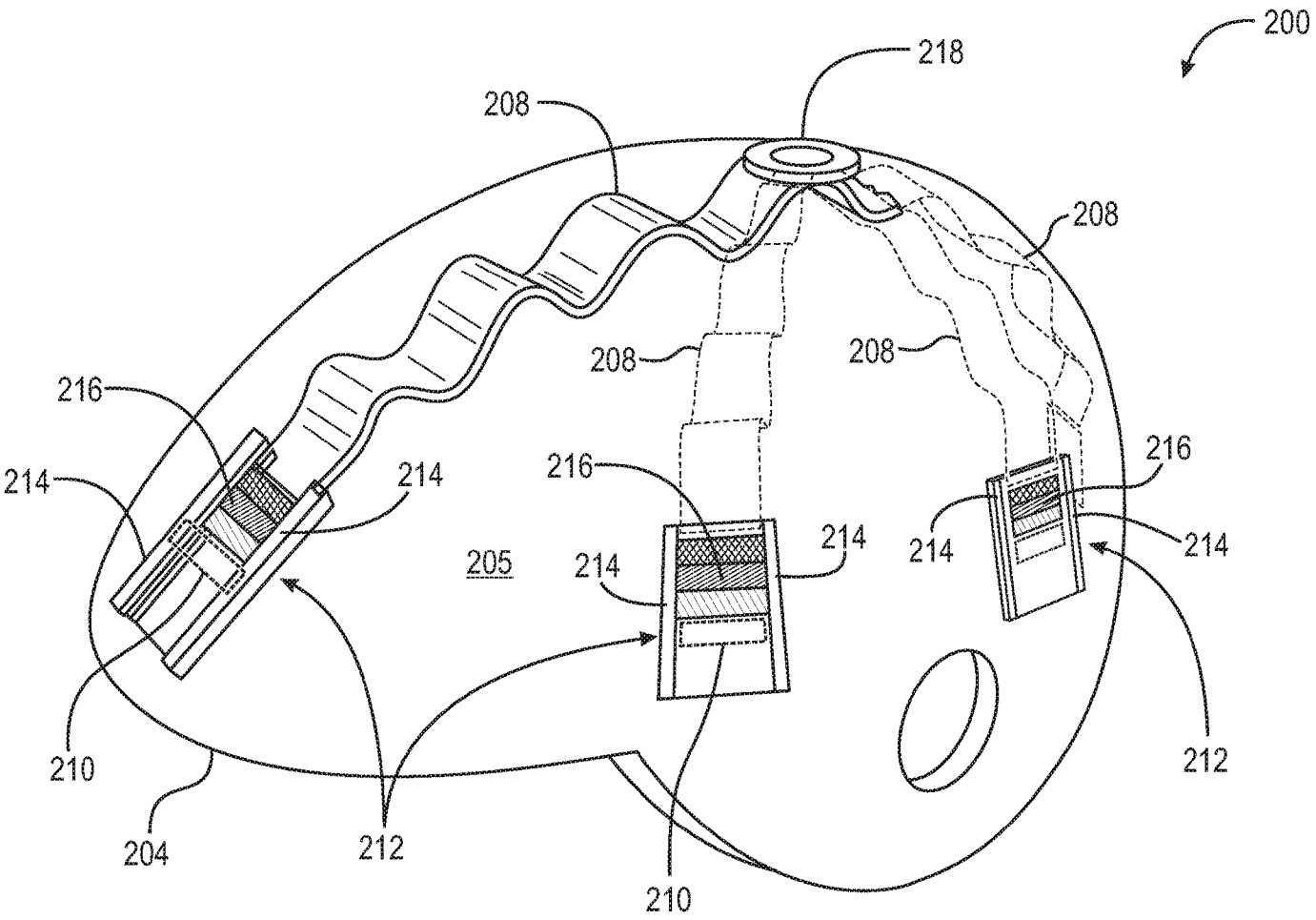
FIG. 1 is a side perspective view of an additional embodiment of a protective helmet.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

In one embodiment, the inner shell and outer shell are connected to each other by elastomeric cords that serve to limit the rotation of the outer shell on the inner shell and to dissipate energy by virtue of elastic deformation rather than passively transferring rotational force to the brain as with existing helmets. In effect, these elastomeric cords function like mini bungee cords that dissipate both angular and linear forces through a mechanism known as hysteretic damping, i.e., when elastomeric cords are deformed, internal friction causes high energy losses to occur. These elastomeric cords are of particular value in preventing so called contrecoup brain injury.

The outer shell, in turn, floats on the inner shell by virtue of one or more force absorbers or deflectors such as, for example, fluid-filled bladders, leaf springs, or sinusoidal springs, located between the inner shell and the outer shell. To maximize the instantaneous reduction or dissipation of a linear and/or angular force applied to the outer shell, the fluid-filled bladders interposed between the hard inner and outer shells may be intimately associated with, that is located under, one or more apertures in the outer shell with the apertures preferably being covered with elastomeric diaphragms and serving to dissipate energy by bulging outward against the elastomeric diaphragm whenever the outer shell is accelerated, by any force vector, toward the inner shell. Alternatively, the diaphragms could be located internally between inner and outer shells, or at the inferior border of the inner and outer shells, if it is imperative to preserve surface continuity in the outer shell. This iteration would necessitate separation between adjacent bladders to allow adequate movement of associated diaphragms.

In existing fluid-filled designs, when the outer shell of a helmet receives a linear force that accelerates it toward the inner shell, the interposed gas or fluid is compressed and displaced. Because gas and especially fluid is not readily compressible, it passes the force passively to the inner shell and hence to the skull and the brain. This is indeed the very mechanism by which existing fluid-filled helmets fail. The transfer of force is hydraulic and essentially instantaneous, negating the effectiveness of viscous fluid transfers as a means of dissipating concussive force.

Because of the elastomeric diaphragms in the present invention, any force imparted to the outer shell will transfer to the gas or liquid in the bladders, which, in turn, will instantaneously transfer the force to the external elastomeric diaphragms covering the apertures in the outer shell. The elastomeric diaphragms, in turn, will bulge out through the aperture in the outer shell, or at the inferior junction between inner and outer shells thereby dissipating the applied force through elastic deformation at the site of the diaphragm rather than passively transferring it to the padded lining of the inner shell. This process directs energy away from the brain and dissipates it via a combination of elastic deformation and tympanic resonance or oscillation. By oscillating, an elastic diaphragm employs the principle of hysteretic damping over and over, thereby maximizing the conversion of kinetic energy to low-level heat, which, in turn, is dissipated harmlessly to the surrounding air.

Furthermore, the elastomeric springs or cords that bridge the space holding the fluid-filled bladders (like the arachnoid membrane in the brain) serve to stabilize the spatial relationship of the inner and outer shells and provide additional dissipation of concussive force via the same principle of elastic deformation via the mechanism of stretching, torsion, and even compression of the elastic cords.

By combining the bridging effects of the elastic springs or cords as well as the elastomeric diaphragms strategically placed at external apertures, both linear and rotational forces can be effectively dissipated.

In an alternate embodiment, leaf springs may replace fluid-filled bladders as a force absorber/deflector. Leaf springs may be structured as a fully elliptical spring or, preferably, formed in a parabolic shape. In both forms, the leaf spring is anchored at a single point to either the outer shell or, preferably, the hard inner shell and extends into the zone between the outer shell and inner shell. The springs may have a single leaf (or arm) or comprise a plurality of arms arrayed radially around a common anchor point. Preferably, each arm tapers from a thicker center to thinner outer portions toward each end of the arm. Further, the ends of each arm may include a curve to allow the end to more easily slide on the shell opposite the anchoring shell. In contrast to the use of leaf springs in vehicles, the distal end of the spring arms are not attached to the nonanchoring or opposite shell. This allows the ends to slide on the shell to allow independent movement of each shell when the helmet is struck by rotational forces. This also enables the frictional dissipation of energy. Preferably, the distal ends contact the opposite shell in the neutral condition, that is, when the helmet is not in the process of being struck.

Adverting to the drawings, FIG. 1 is a side perspective view of a further additional embodiment of the helmet with outer shell 202 removed. Helmet 200 includes an integral or continuous outer shell 202 (not shown in FIG. 1) and inner shell 204 functionally connected. By integral or continuous is meant that shell 202 is formed as a single unit. By functionally connected, it is meant that outer shell 202 and inner shell 204 are connected such that outer shell 202 may move, such as rotate, relative to inner shell 204 such as, for example, the sliding connection 22 discussed above. Elastomeric zone 203 ("zone 203") lies between outer shell 202 and inner shell 204. At least one sinusoidal spring 208 (spring(s) 208") is positioned in zone 203. FIG. 1 depicts a preferred embodiment in which a plurality of springs 208 are positioned in zone 203. In a more preferred embodiment shown here, springs 208 are sinusoidal springs 208 having a shape similar to or identical with a series of sine waves and can be manufactured as described in U.S. Patent Application Publication No. 2012/00773884 and U.S. Pat. No. 4,708,757 both to Guthrie, which patent publications are hereby incorporated by reference in their entireties.

Although not necessary for the protective function of helmet 200, in a further embodiment, the distal end of at least one of springs 208 is in operative contact with force indicator tab 216 ("tab 216"). By "operative contact" it is meant that a component or device contacts but is not connected to a second component and causes that second component to function. For example, as described below, the operative contact end of spring 208 contacts the proximal edge of tab 216 so that when spring 208 is extended, it pushes tab 216 to an outer position toward the outer perimeter of helmet 200. When spring 208 retracts, tab 216 remains in its displaced position. Tab 216 preferably is a multi-color panel as represented by the different cross hatching patterns on the surface of tab 216, shown in FIG. 1.

Tab 216 is positioned within channel 212, which is positioned on outer surface 205 of inner shell 204. Channel 212 includes parallel rails 214 with tab 216 positioned between rails 214. In this way, tab 216 is always pushed in the same direction when spring 208 is extended. Outer shell 202 defines at least one window 210, shown in shadow, positioned so that tab 216 can be viewed through window 210 if spring 208 is extended sufficiently to push tab 216 into channel 212. In the embodiment shown, rivet 218 forms the attachment of the plurality of springs 208 to outer shell 202 to form a radial or "spider-like" array of springs 208. In the preferred embodiment, outer shell 202 is functionally connected to inner shell 204 such that window 210 remains at a constant location relative to inner shell 204. The disclosure described herein refers to this embodiment. It should be appreciated that outer shell 202 is functionally attached to inner shell 204 such that movement of outer shell 202 relative to inner shell 204 does not affect the location of tab 216 (i.e., outer shell 202 does not contact tab 216). In another embodiment (not shown), outer shell 202 is functionally attached to inner shell 204 such that window 210 varies in location. For example, in a resting or neutral position, window 210 is arranged on outer shell 202 and located in a first location relative to inner shell 204. During (or just after) impact, when outer shell 202 moves relative to inner shell 204, window 210 can be located in a second location, different than the first location. However, outer shell 202 is arranged to always return to its resting or neutral position at a period of time after impact. Thus, window 210 will always return to the first location. Readings of tab 216 should always be conducted when outer shell 202 is in the resting or neutral position and window 210 is located in the first location.

Figure 2:
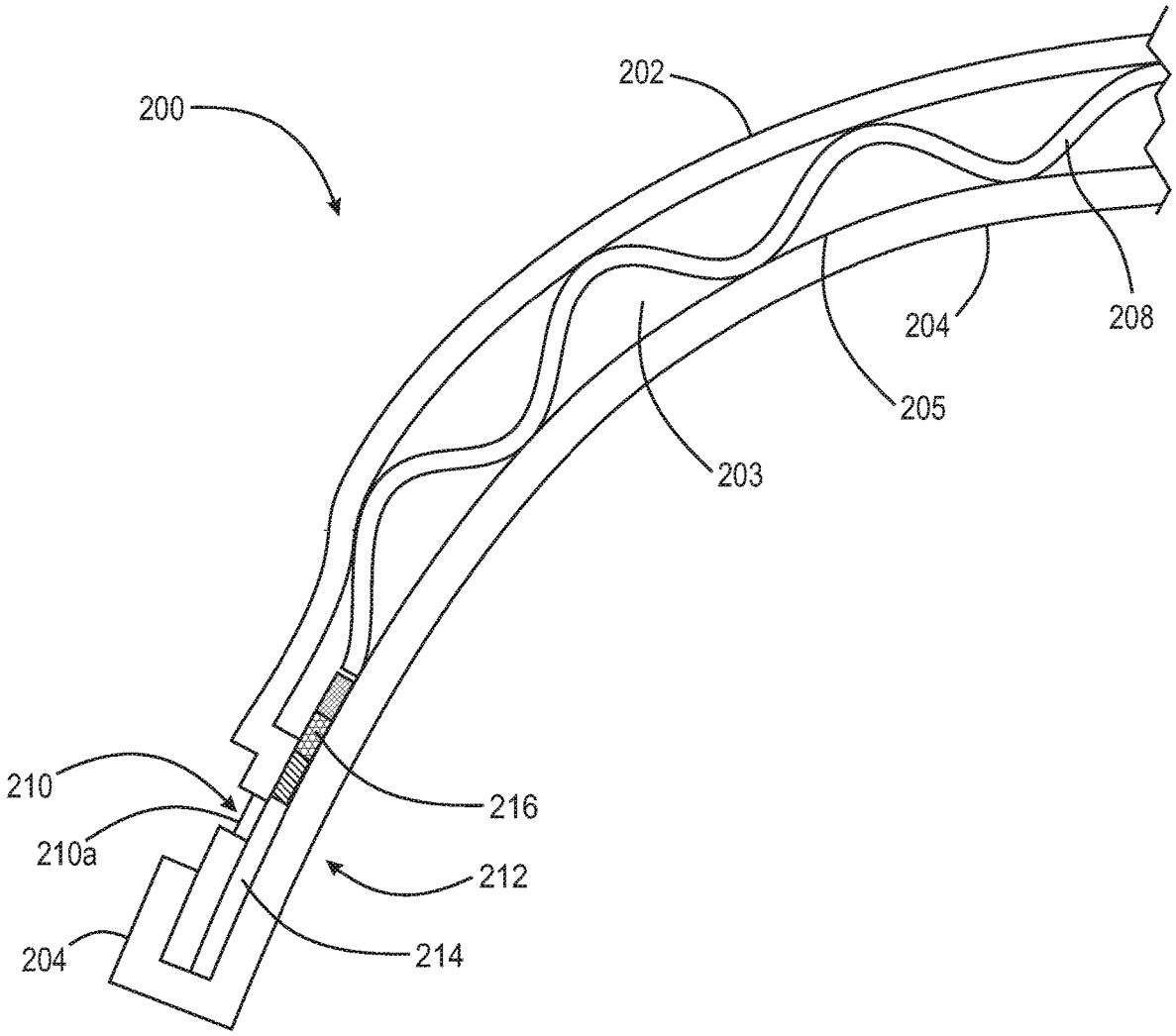
FIG. 2 is a cross-sectional view of a sinusoidal spring of the helmet shown in FIG. 1.

FIG. 2 is a cross-sectional view of helmet 200 through a sinusoidal spring 208. Spring 208 is positioned in elastomeric zone 203 resting on outer surface 205. One end of spring 208 is either close to or in contact with tab 216, which is positioned between rails 214. In the resting or neutral position shown, tab 216 is arranged under outer shell 202 and not exposed in window 210. Spring(s) 208 may be attached to outer shell 202, inner shell 204, or both outer shell 202 and inner shell 204. Helmet 200 may also comprise substrate 210*a* arranged over window 210.

Figure 3:
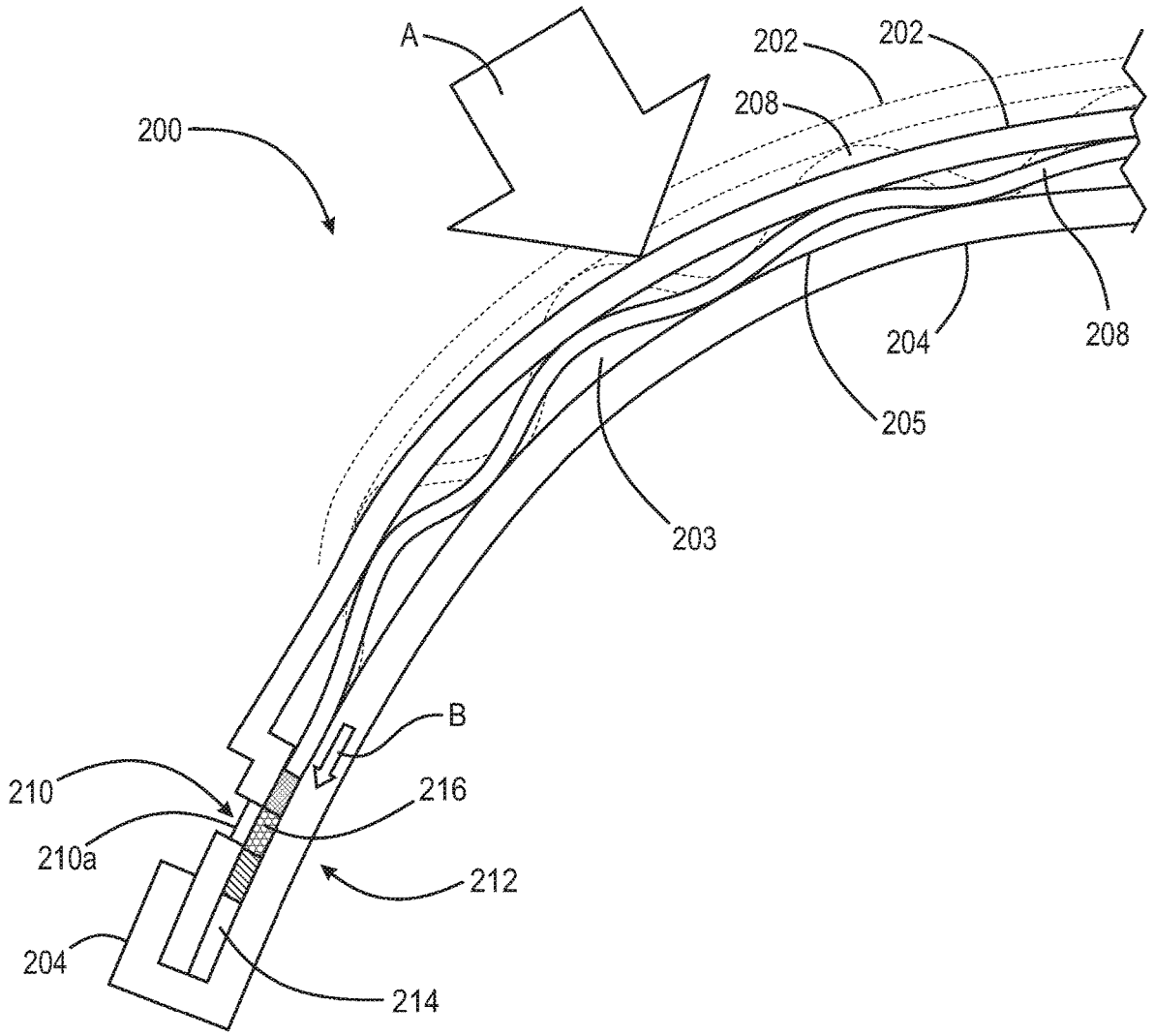
FIG. 3 shows the same view as the view shown in FIG. 2 showing force, such as from a blow or hit, being applied to the helmet.

FIG. 3 shows the same view of helmet 200 as shown in FIG. 2 in which force A, represented by arrow A, is applied to helmet 200. The force may be a blow impacting helmet 200. The dotted lines of outer shell 202 and spring 208 show those components in the neutral state. The solid lines show outer shell 202 pressed into elastomeric zone 203 by force A. When force A strikes outer shell 202, one or more of springs 208 are pushed into a compressed mode as shown by the reduced amplitude of the sine wave formed in sinusoidal spring 208 as well as the expanded length of spring 208. As spring 208 lengthens, as represented by arrow B, it pushes tab 216 toward and/or into window 210. Persons of ordinary skill in the art will recognize that the increase in the length of spring 208 is a function of the amount of force striking helmet 200. Thus, the amount of exposure of tab 216 in window 210 depends on the amount of force striking helmet 200. Preferably, tab 216 includes different colors, such as green, yellow, and red, or other indicators, each of which may appear in window 210 depending on the force of the blow. It will be recognized that more than one spring 208 may be extended when helmet 200 is struck.

Figure 4:
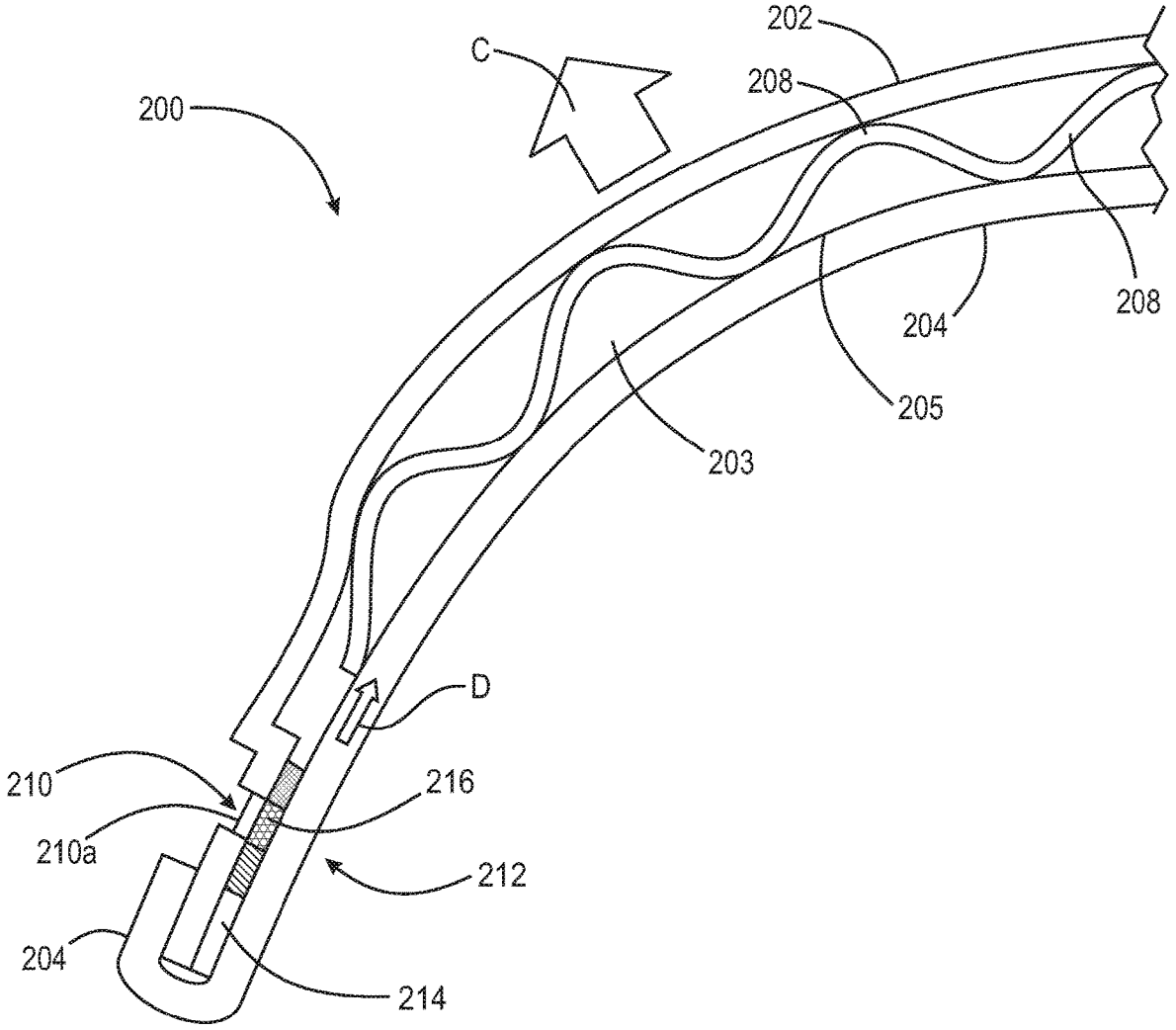
FIG. 4 depicts the same view shown in FIGS. 2 and 3 after the outer shell and sinusoidal spring have returned to the neutral position.

FIG. 4 depicts the same view shown in FIGS. 2 and 3 after outer shell 202 and sinusoidal spring 208 have returned to the neutral position. The return movement of outer shell 202 is shown by arrow C while the return of spring 208 is shown by arrow D. Tab 216 remains under window 210 after spring 208 retracts back to its normal state.

Figure 5:
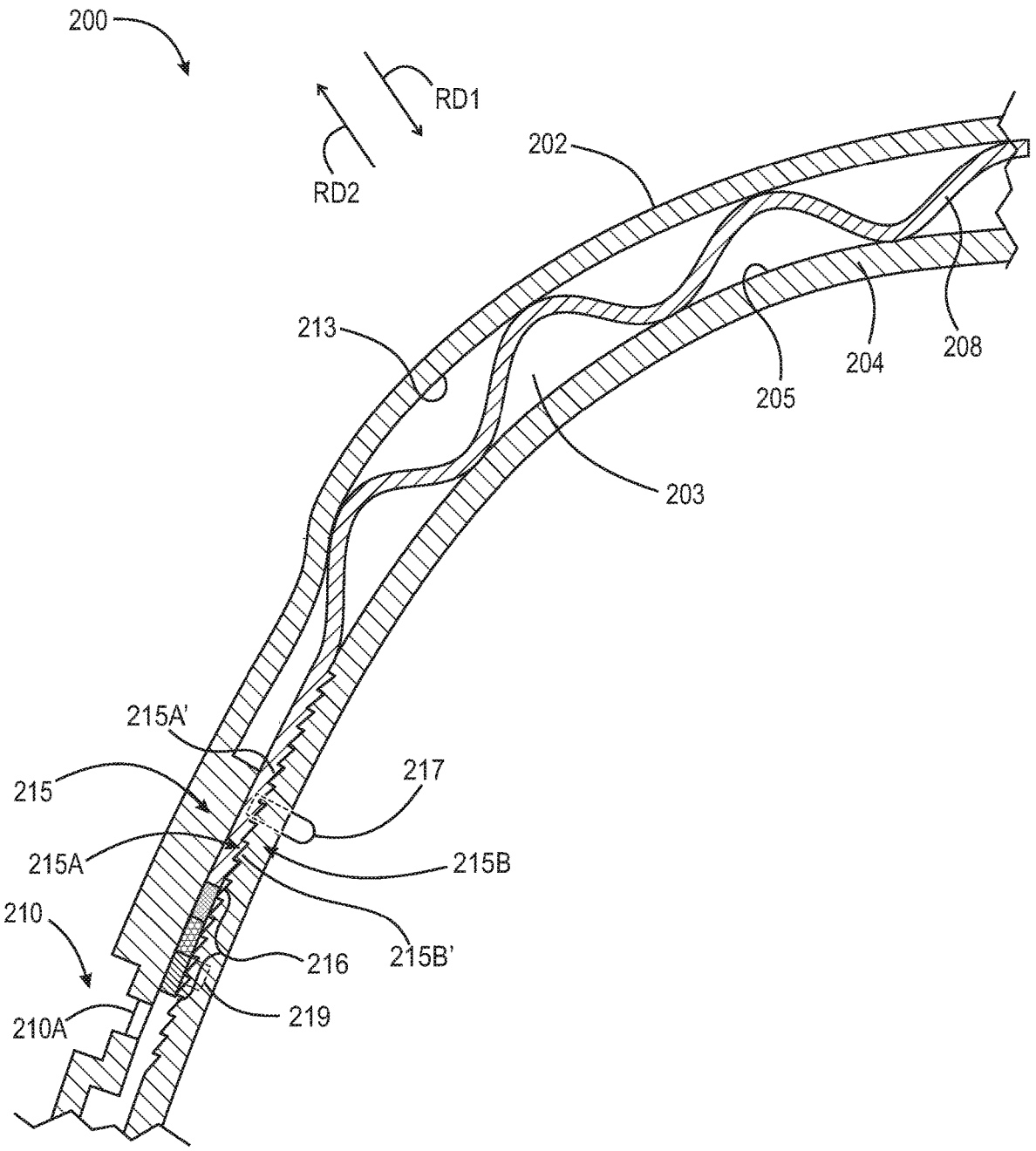
FIG. 5 is a cross-sectional view of an alternative embodiment of the helmet shown in FIG. 1.

FIG. 5 is a cross-sectional view of an alternative embodiment of the helmet shown in FIG. 1. In the alternative embodiment shown, helmet 200 further comprises energy dissipation device 215 arranged radially between outer shell 202 and inner shell 204. Energy dissipation device 215 comprises first portion 215A and second portion 215B, which are arranged to engage, and lock, with each other. In this exemplary embodiment, first portion 215A is connected to spring 208 and comprises plurality of teeth 215A' facing radially inward in direction RD1. Second portion 215B is connected to inner shell 204 and comprises plurality of teeth 215B' facing radially outward in direction RD2. Energy dissipation device 215 further comprises release 217 for disengaging first portion 215A and second portion 215B. For example, pressing release 217 displaces first portion 215A radially outward in direction RD2 and disengages teeth 215A' of first portion 215A from teeth 215B' of second portion 215B. Indicator tab 216 comprises return tab 219 connected thereto. Return tab 219 is arranged radially inward of indicator tab 216 such that the user can return indicator tab 216 to the position shown in FIG. 5. Helmet 200 may also comprise substrate 210*a* arranged over window 210 such that indicator tab 216 can only be accessed using return tab 219 inside helmet 200 (i.e., indicator tab 216 cannot be accessed through window 210).

Figure 6:
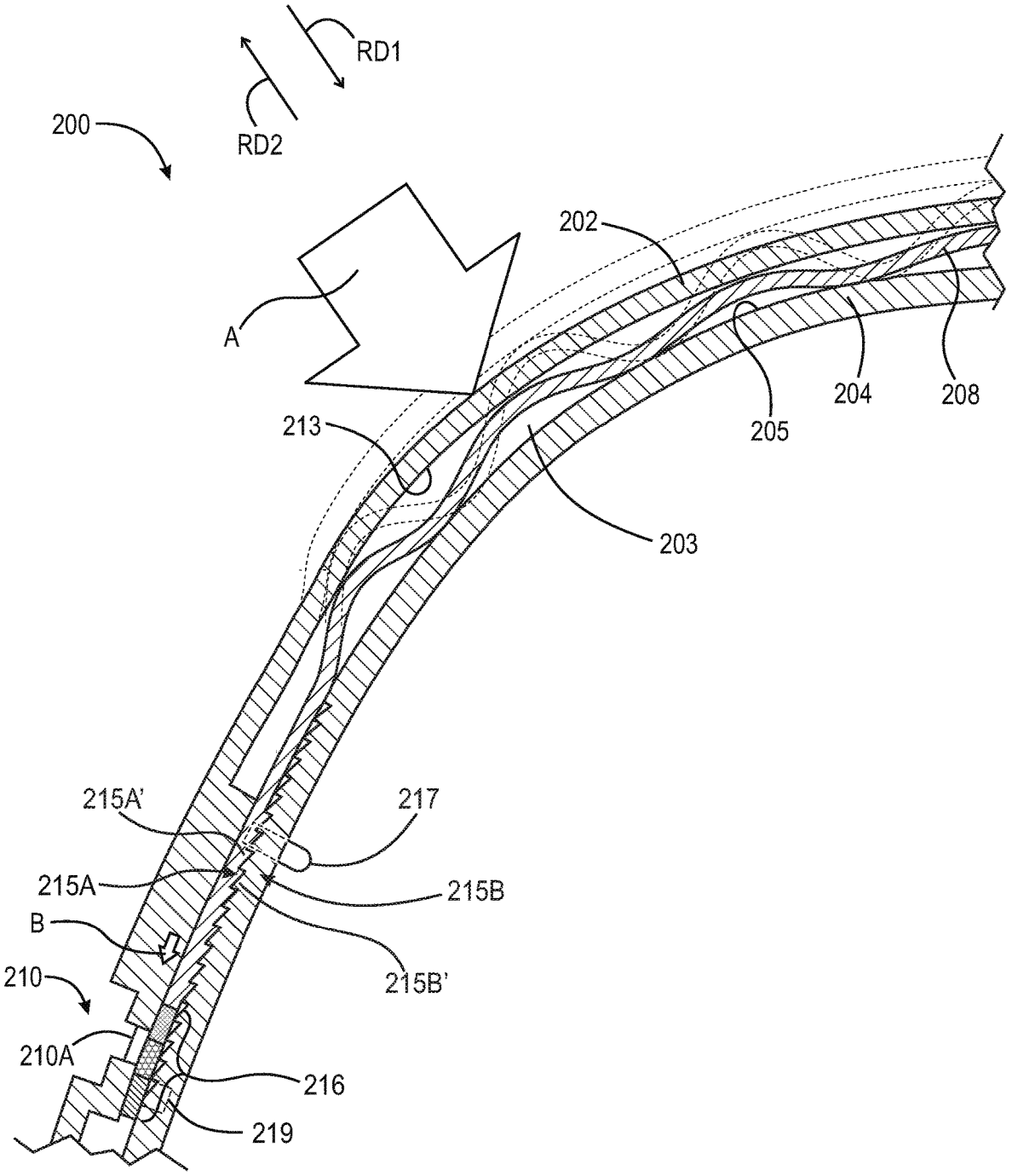
FIG. 6 shows the same view as the view shown in FIG. 5 showing force, such as from a blow or hit, being applied to the helmet.

FIG. 6 shows the same view of helmet 200 as shown in FIG. 5 in which force A, represented by arrow A, is applied to helmet 200. The effect of the force is the same as that shown and described with respect to FIG. 3 above. However, as spring 208 extends in direction B, first portion 215A displaces in direction B relative to second portion 215B, which displaces indicator tab 216. First portion 215A engages with second portion 215B, for example, via teeth 215A' and 215B'. In this exemplary embodiment, outer shell 202 is functionally connected to inner shell 204 such that window 210 remains in a constant location and does not vary in size (i.e., outer shell 202 does not displace circumferentially relative to inner shell 204 at or around the location of window 210).

Figure 7:
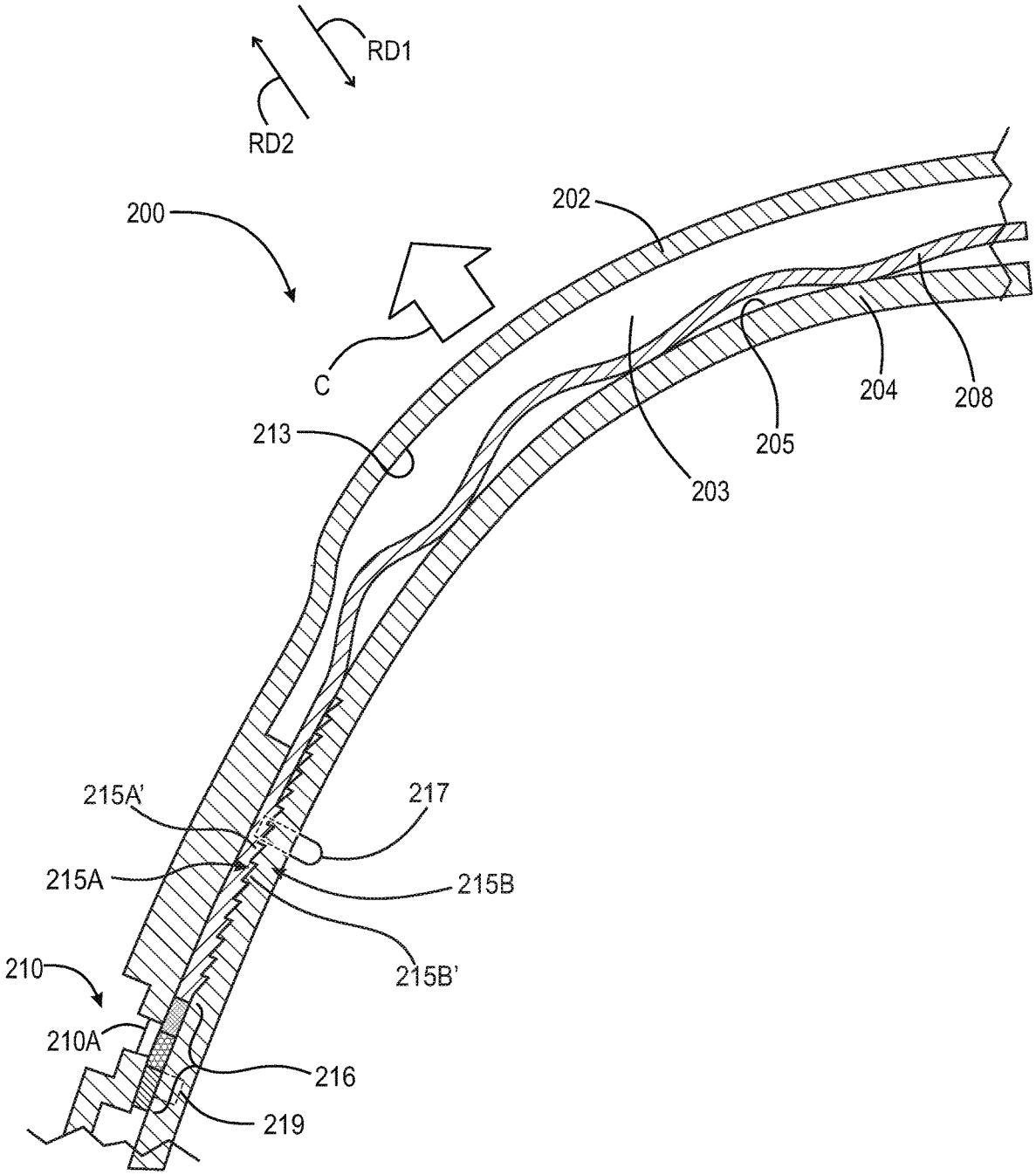
FIG. 7 depicts the same view shown in FIGS. 5 and 6 after the outer shell has returned to the neutral position.
Figure 8:
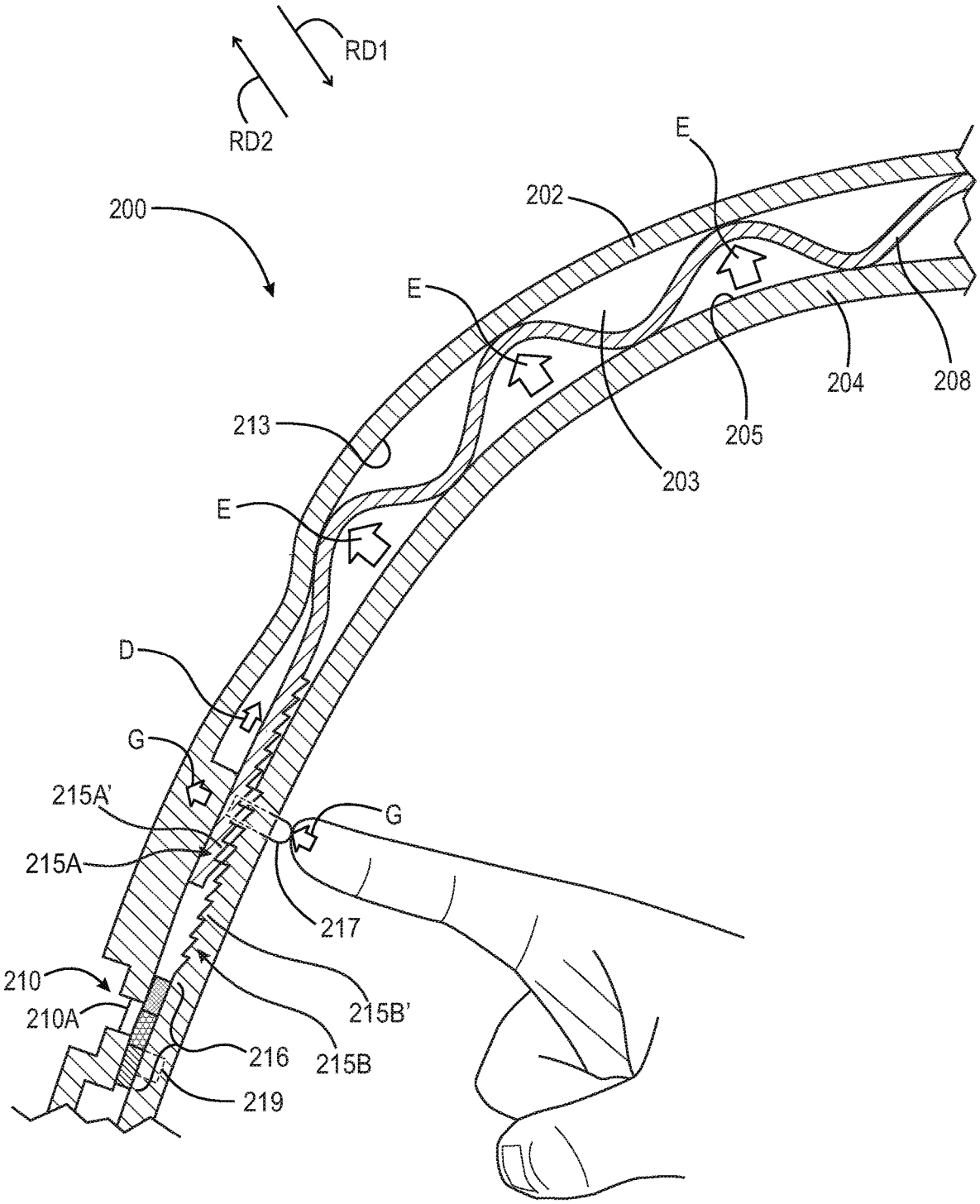
FIG. 8 shows the disengagement of an energy dissipation device and the return of the sinusoidal spring to the neutral position.
Figure 9:
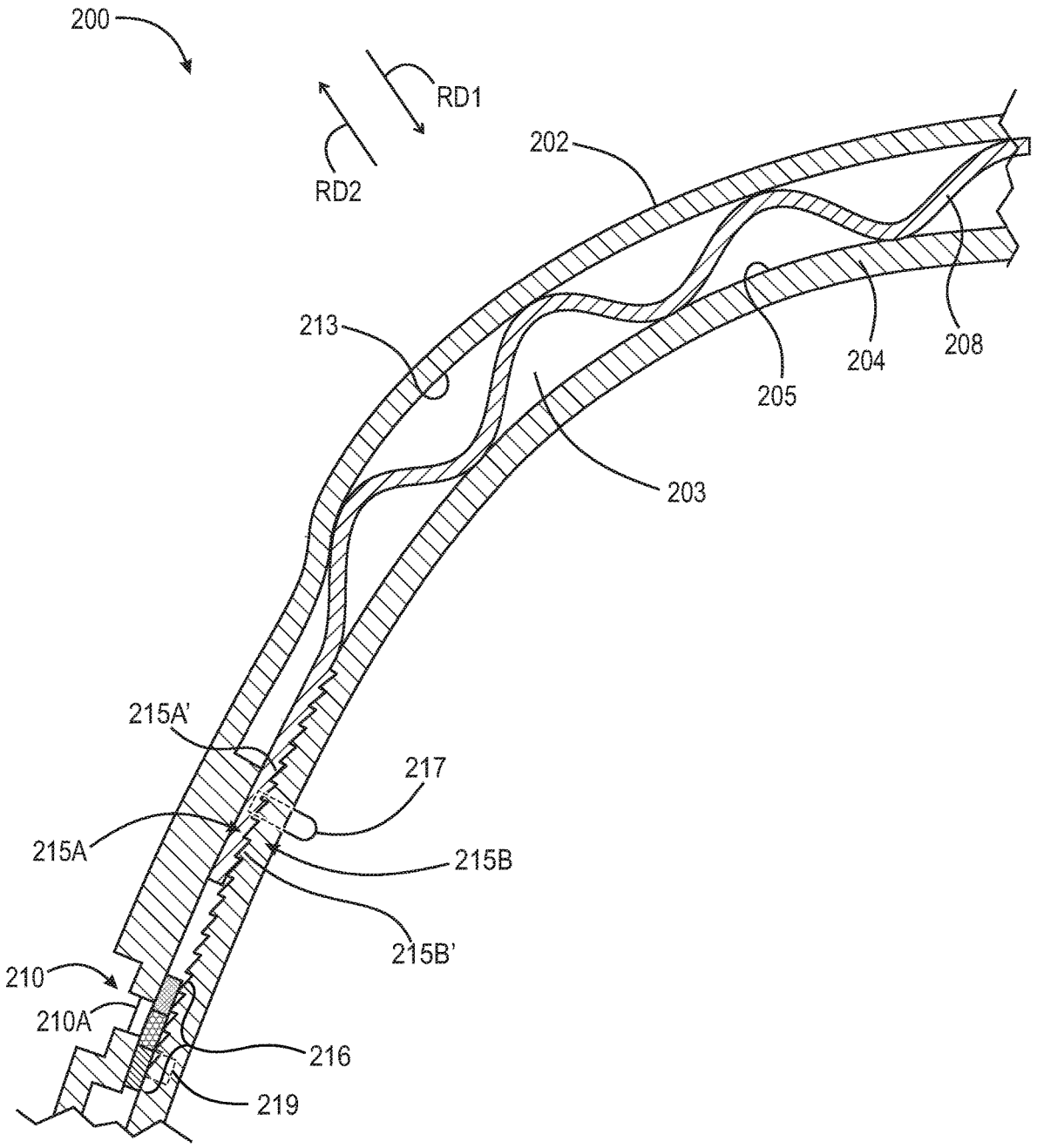
FIG. 9 shows the helmet as shown in FIGS. 6-8 after the energy dissipation device has been completely disengaged.

FIG. 7 depicts the same view shown in FIGS. 5 and 6 after outer shell 202 has returned to the neutral position. The return movement of outer shell 202 is shown by arrow C. Unlike the embodiment shown in FIG. 4, however, spring 208 does not return to its neutral position because of energy dissipation device 215. First portion 215A is still engaged, and thus locked, with second portion 215B. FIG. 8 shows the disengagement of energy dissipation device 215, wherein release 217 is activated. In an example embodiment, release 217 is connected to first portion 215A and is displaced in direction G to disengage energy dissipation device 215. For example, pressing release 217 displaces first portion 215A radially outward in direction RD2 (or G) and disengages teeth 215A' from teeth 215B'. The return of first portion 215A is shown by arrow D while the return of spring 208 is shown by arrows D and E. In another example embodiment, a transmission device can be used to send a signal indicating when tab 216 is displaced into window 210, so that another party (e.g., coach, doctor, medical professional, parent, etc.) is aware that a significant impact has occurred from a remote location (i.e., without having to be within viewing distance of window 210). In addition, the transmission device can be used to send a signal indicating the position of tab 216 in window 210, so that the party is aware of the magnitude of impact that occurred from the remote location. The transmission device is described in greater detail below with respect to FIG. 11. FIG. 9 shows helmet 200 after energy dissipation device 215 has been completely disengaged. The position of tab 216 remains in window 210 after spring 208 retracts back to its normal state.

Figure 10:
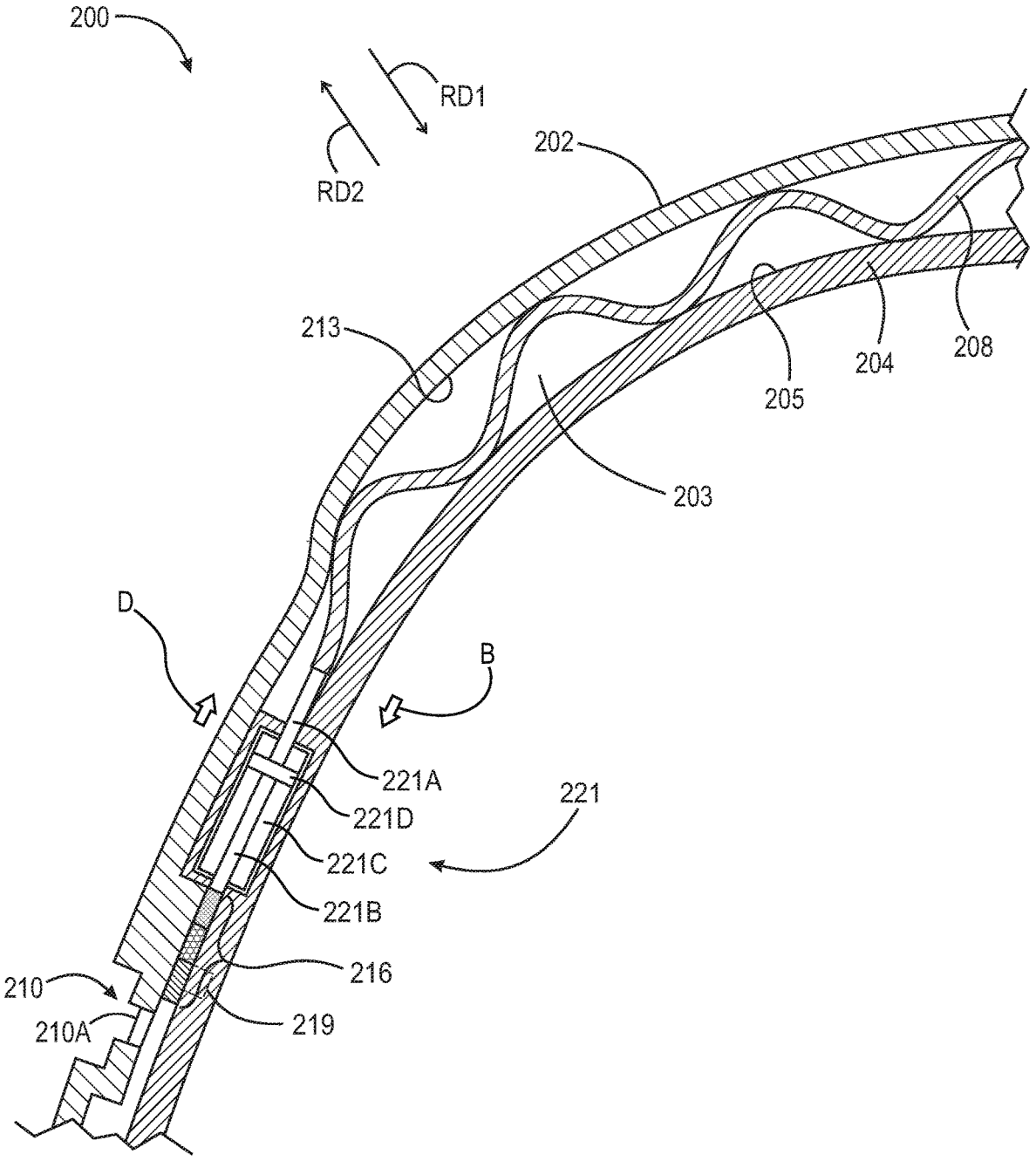
FIG. 10 is a cross-sectional view of an alternative embodiment of the helmet shown in FIG. 1.

FIG. 10 is a cross-sectional view of an alternative embodiment of the helmet shown in FIG. 1. In the alternative embodiment shown, helmet 200 further comprises piston device 221 arranged in inner shell 204. In another embodiment, piston device 221 is arranged at any suitable location radially between inner shell 204 and outer shell 205. Piston device 221 is an energy dissipation device comprising first rod 221*a*, second rod 221*b*, cylinder 221*c*, and flange 221*d*. First rod 221*a* is connected to spring 208 at a first end and flange 221*d* at a second end. Second rod 221*b* is connected to flange 221*d* at a first end and abuts against indicator tab 216 at a second end. Flange 221*d* is arranged in cylinder 221*c*. In an example embodiment, piston device 221 acts similar to a dashpot or any other suitable device such that displacement of spring 208 in direction B is not inhibited and the return of spring 208 in direction D occurs at a controlled rate, preferably slowly. In this embodiment, there is no need for a release because spring 208 always returns to its neutral position. Piston device 221 can be a hydraulic piston, a pneumatic piston, or any other suitable device capable of performing the above-identified function.

Figure 11:
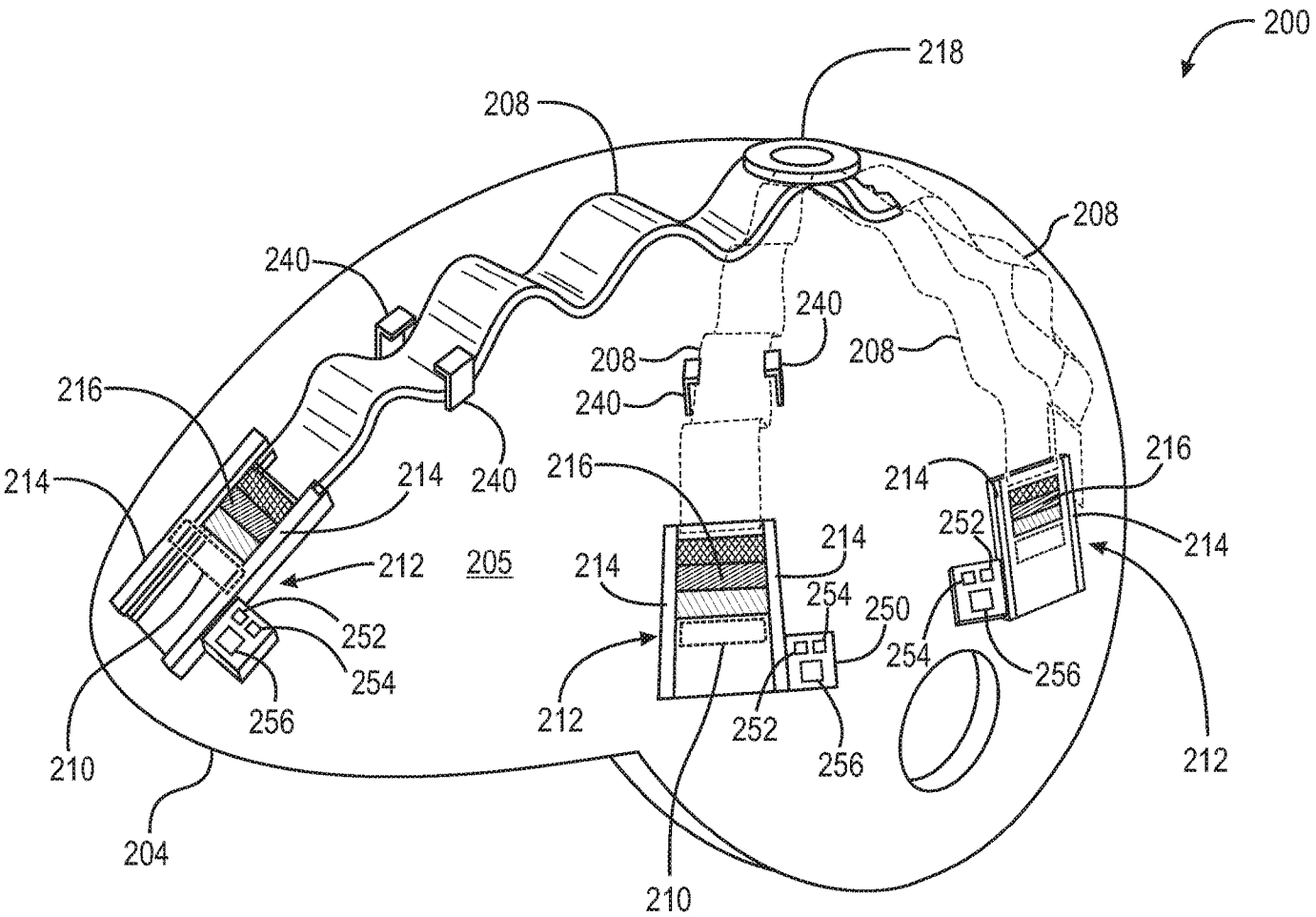
FIG. 11 is a top perspective view of the alternative embodiment of the helmet shown in FIG. 10.

FIG. 11 is a top perspective view of an alternative embodiment of the helmet shown in FIG. 1. In this embodiment, helmet 200 comprises a plurality of brackets 240. Brackets 240 are connected to inner shell 204 and arranged adjacent to springs 208. Brackets 240 prevent and/or limit springs 208 from moving laterally. This system provides torsional damping as well as linear damping. Brackets 240 allow spring 208 to function as a torsion bar thereby mitigating rotational or angular force applied to helmet 200. Helmet 200 further comprises transmission device 250. Transmission device 250 is arranged to send a signal to a receiver (not shown) at a remote location indicating that an impact has occurred. Transmission device 250 generally comprises sensor 252, transmitter 254, and power source 256. Power source 256 is intended to be a battery or any combination of multiple batteries that can produce sufficient voltage to power the components and circuitry in transmission device 250 (i.e., sensor 252 and transmitter 254). Transmitter 254 includes an antenna and is operatively arranged to communicate with a remote receiver (e.g., a computer, a smartphone, an iPad® tablet computer, a Surface® computer, or any other computing device) and can be utilized to send/receive a wireless signal/communication. It should be appreciated that "wireless communication(s)" as used herein is intended to mean Radio Frequency Identification (RFID) communication, Bluetooth® protocols, Near field Communication (NFC), Near Field Magnetic Inductance Communication (NFMIC), Wi-Fi, LTE, Airdrop® communication, or any other wireless protocol sufficient to communicate with the remote receiver. Sensor 252 is any device, module, or subsystem capable of detecting that an impact has occurred and sending that information to transmitter 254 to be transmitted to a remote receiver. Sensor 252 is arranged to sense and store the position of indicator force indicator tab 216. It should be appreciated that sensor 252 could be embodied as an optical sensor, limit switch, or other device capable of sensing a position of force indicator tab 216. In an example embodiment, senor 252 could be embodied as a vibration sensor, magnetic sensor, position sensor, impact sensor, or any other sensor capable of detecting an impact or a movement of force indicator tab 216.

In an example embodiment, and as previously discussed, transmission device 252 is used to send a signal indicating when tab 216 is displaced into window 210, so that another party (e.g., coach, doctor, medical professional, parent, etc.) is aware that a significant impact has occurred from a remote location (i.e., without having to be within viewing distance of window 210). In addition, the transmission device can be used to send a signal indicating the position of tab 216 in window 210, so that the party is aware of the magnitude of impact that occurred from the remote location.

In an example embodiment, transmission device 250 further comprises a microcontroller. The microcontroller may include a memory element and a processing unit. The memory element is capable of storing a set of non-transitory computer readable instructions. The processing unit is arranged to execute the set of non-transitory computer readable instructions.

In an example embodiment, the microcontroller is programmed to perform the following steps: receive an indication from sensor 252 that an impact has occurred; send a signal to a remote receiver through transmitter 254 indicating that an impact has occurred.

In an example embodiment, the microcontroller is programmed to perform the following steps: receive an indication from sensor 252 that an impact force has occurred; determine if the impact force is greater than a predetermined threshold force; if the impact force is greater than the predetermined threshold force, send a signal to a remote receiver through transmitter 254 indicating that an impact has occurred.

In an example embodiment, the microcontroller is programmed to perform the following steps: receive a set of data from sensor 252 that an impact force has occurred; determine the magnitude of the impact force based on the set of data; send a signal to a remote receiver through transmitter 254 indicating the magnitude of the impact force.

Figure 12:
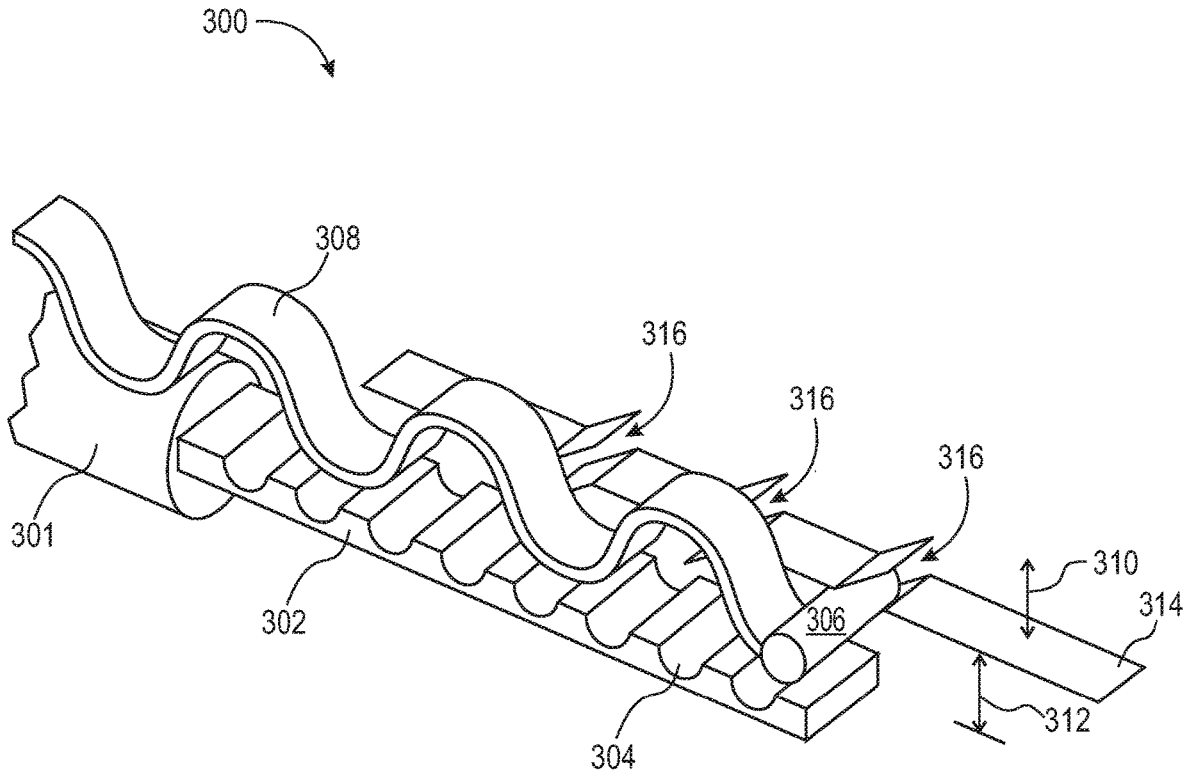
FIG. 12 is a top perspective view of the alternative embodiment of an energy dissipation device used in the helmet shown in FIG. 10.

FIG. 12 is a top perspective view of an alternative embodiment of energy dissipation device 300 used in helmet 200 shown in FIG. 1. Energy dissipation device 300 comprises dashpot 301, arm 302, cylinder 306, and barrier 314. Dashpot 301 is a linear mechanical device, a damper which resists motion via viscous friction. Arm 302 comprises a plurality of notches and is slidingly engaged within dashpot 301. Cylinder 306 is connected to sinusoidal spring 308 and is arranged to slide in levels 310 and 312. Levels 310 and 312 are separated by barrier 314. Barrier 314 comprises a plurality of doors 316, which are operatively arranged to allow cylinder 306 to pass from level 310 to level 312. Barrier 314 also comprises door 318, which is operatively arranged to allow cylinder 306 to pass from level 312 to level 310.

Figure 13:
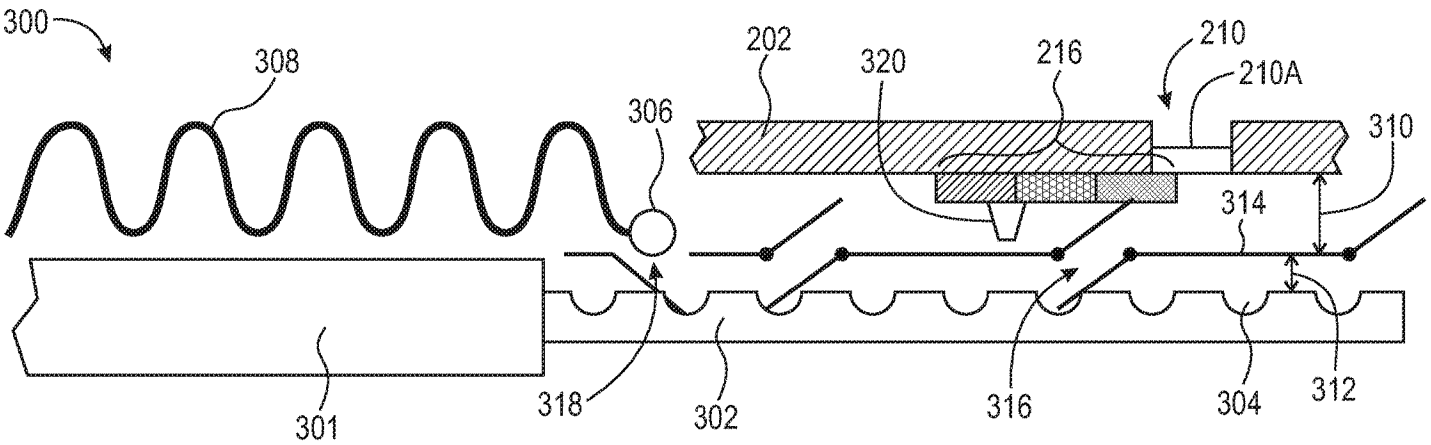
FIG. 13 is a cross-sectional view of the energy dissipation device shown in FIG. 12.
Figure 14:
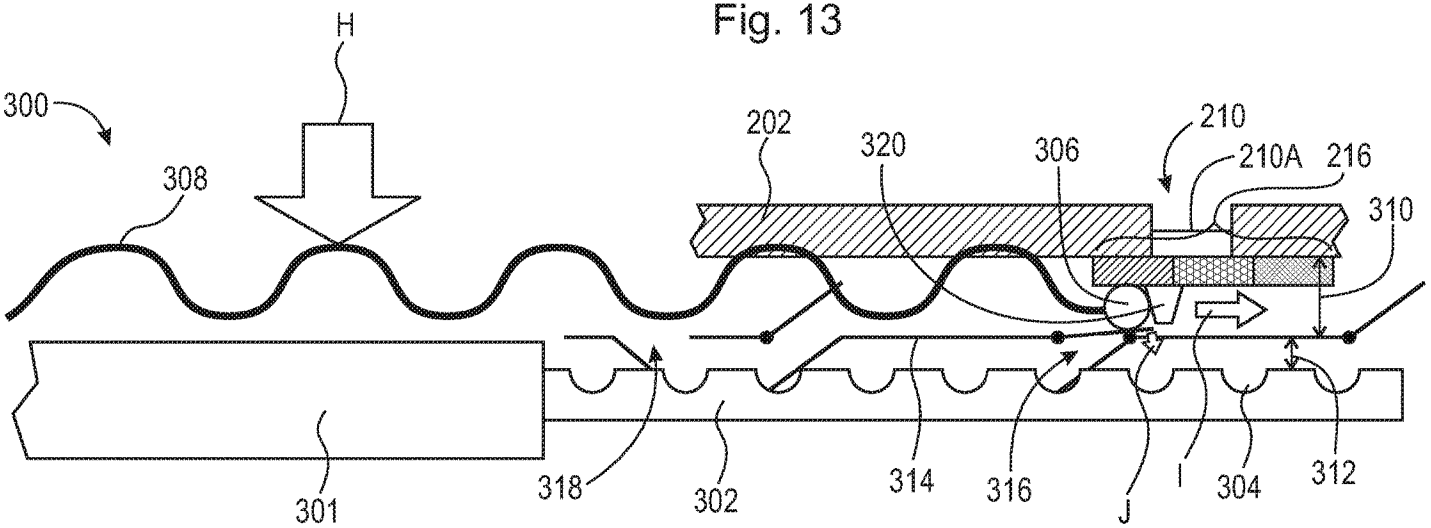
FIG. 14 is a cross-sectional view of the energy dissipation device shown in FIG. 12.
Figure 15:
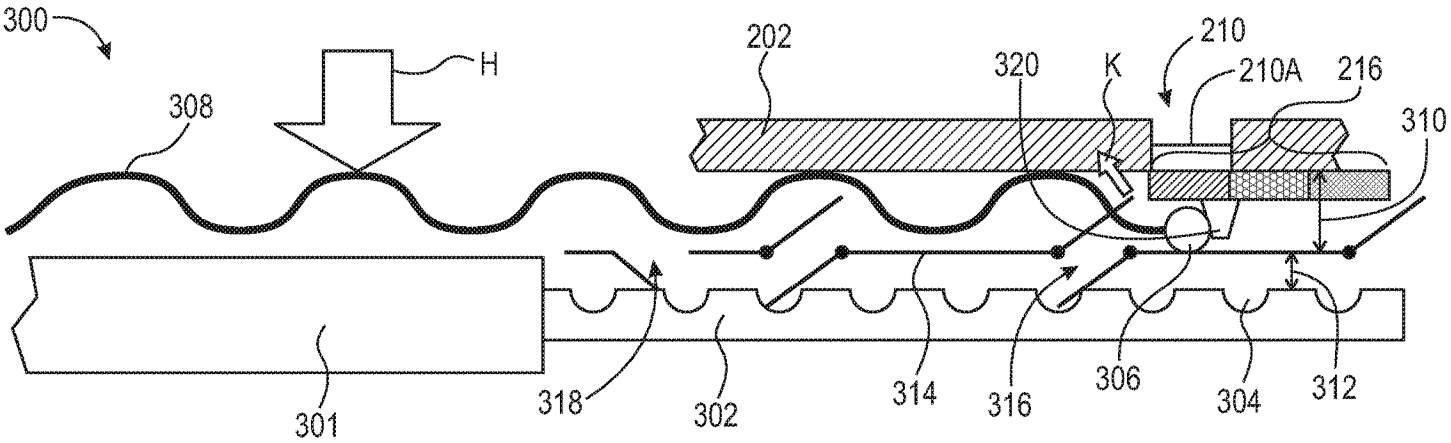
FIG. 15 is a cross-sectional view of the energy dissipation device shown in FIG. 12.
Figure 16:
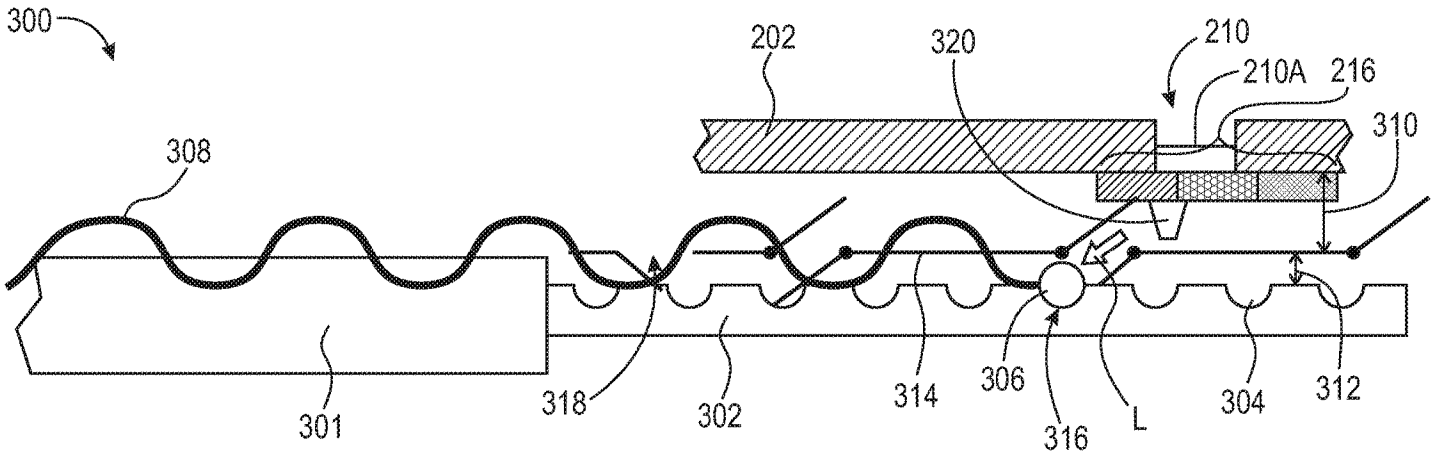
FIG. 16 is a cross-sectional view of the energy dissipation device shown in FIG. 12.
Figure 17:
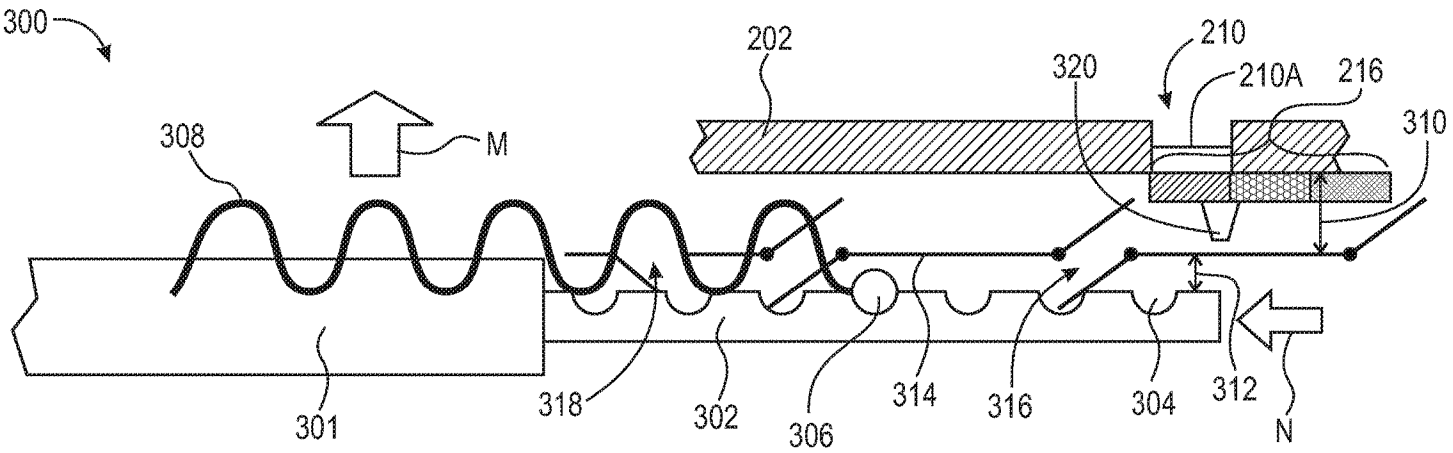
FIG. 17 is a cross-sectional view of the energy dissipation device shown in FIG. 12; and, FIG. 18 is a cross-sectional view of the energy dissipation device shown in FIG. 12.
Figure 18:
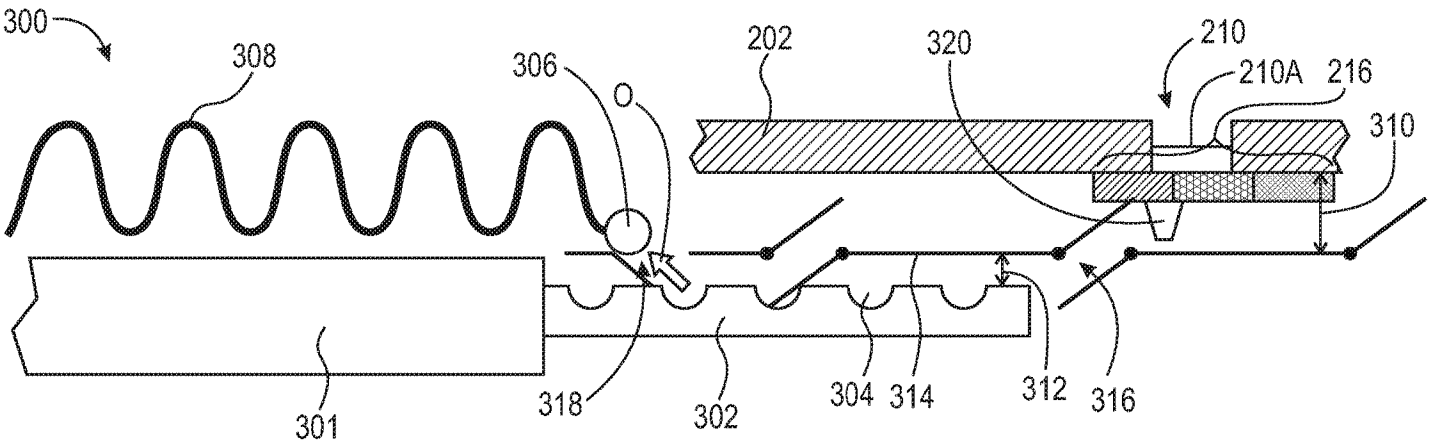

FIGS. 13-18 are cross-sectional views of energy dissipation device 300 shown in FIG. 12. FIG. 13 shows energy dissipation device 300 in a neutral position. Cylinder 306 is arranged in level 310 and arm 302 is fully extended from dashpot 301. FIG. 14 shows energy dissipation device 300 during an impact in direction H. Sinusoidal spring 308, and thus cylinder 306, extends along level 310 in direction I. Cylinder 306 displaces extension 320 and moves force indicator tab 216 into window 210. Cylinder 306 also forces door 316 in direction J. FIG. 15 shows energy dissipation device 300 during an impact in direction H. Sinusoidal spring 308 has extended such that cylinder 306 passes over door 316 in level 310. Door 316 moves in direction K to return to its neutral position. FIG. 16 shows energy dissipation device 300 after an impact. Cylinder 306 slips from level 310 to level 312 through door 316 in direction L. Cylinder 306 then engages one of notches 304 in arm 302. FIG. 17 shows energy dissipation device 300 after an impact. Cylinder 306, now arranged in level 312, engages one of notches 304. Sinusoidal spring 308 returns to its neutral position in direction M, which pulls cylinder 306, and thus arm 302, in direction N. FIG. 18 shows energy dissipation device 300 after an impact. Cylinder 306 slips from level 312 to level 310 through door 318 in direction 0. Sinusoidal spring 308 has returned to the neutral position. Arm 302 returns to its fully extended position relative dashpot 301. It should be appreciated that force indicator tab 216 can be manually returned to a neutral position.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

200 Helmet
202 Outer Shell
203 Elastomeric Zone
204 Inner Shell
205 Outer Surface
208 Sinusoidal Spring (Springs)
210 Window
210*a* Substrate
212 Channel
214 Rails
215 Energy Dissipation Device
215A First Portion
215B Second Portion
215A' Teeth
215B' Teeth
216 Force Indicator Tab(s)
217 Release
218 Rivet
219 Return Tab
221 Piston Device
221*a* First Rod
221*b* Second Rod
221*c* Cylinder
221*d* Flange
240 Brackets
250 Radio Communication Device
252 Sensor
254 Transmitter
256 Power Source
300 Energy Dissipation Device
301 Dashpot
302 Arm
304 Notches
306 Cylinder
308 Sinusoidal Spring
310 Level
312 Level
314 Barrier
316 Doors
318 Door
320 Extension
A Force (Force Arrow)
B Direction
D Direction
G Direction
H Direction
I Direction
J Direction
K Direction
L Direction
M Direction
N Direction
O Direction
RD1 Radial Direction
RD2 Radial Direction

What is claimed is:

1. A protective helmet having multiple protective zones, comprising:
   an inner shell having a first inner surface and a first outer surface;
   an outer shell having a second inner surface, a second outer surface, and at least one window defined by said outer shell, said outer shell functionally attached to said inner shell;
   an elastomeric zone between said first outer surface and said second inner surface;
   a plurality of sinusoidal springs positioned in said elastomeric zone, each of the plurality of sinusoidal springs comprising:
      a first end; and,
      a second end;
   a force indicator tab in operative contact with said second end of at least one of said plurality of sinusoidal springs, wherein said force indicator tab is displaced in said at least one window by said second end when said helmet is impacted with sufficient force; and, a transmission device.

2. The protective helmet as recited in claim 1, further comprising a plurality of piston devices arranged between the inner and outer shells, wherein each of said plurality of piston devices comprises:
   a first component connected to the second end; and,
   a second component.

3. The protective helmet as recited in claim 2, wherein the second component comprises:
   a dashpot;
   an arm including a plurality of notches, the arm slidingly engaged with the dashpot; and,
   a barrier including a plurality of doors.

4. The protective helmet as recited in claim 3, wherein the first component is a cylinder and is operatively arranged to:
   move axially along the barrier;
   pass through the plurality of doors; and,
   engage the plurality of notches.

5. The protective helmet as recited in claim 1, wherein said first end of at least one of said plurality of sinusoidal springs is attached to said first outer surface.

6. The protective helmet as recited in claim 1, wherein each one of said plurality of sinusoidal springs is attached at a common point on said inner shell.

7. The protective helmet as recited in claim 1, further comprising a plurality of brackets connected to said first outer surface, said second inner surface, or both said first outer surface and said second inner surface, wherein said plurality of brackets are operatively arranged adjacent to said plurality of sinusoidal springs to limit with a lateral and torsional movement of said plurality of sinusoidal springs.

8. The protective helmet as recited in claim 1, wherein said at least one window extends in a generally sagittal direction.

9. The protective helmet as recited in claim 1, wherein said force indicator tab is positioned in a slot or between two rails.

10. The protective helmet as recited in claim 9, wherein said force indicator tab comprises a return tab.

11. The protective helmet as recited in claim 1, wherein the transmission device comprises:
   a power source;
   a sensor arranged to determine a location of the force indicator tab in the window; and,
   a transmitter arranged to transmit a signal indicating the location to a remote receiver.

12. The protective helmet as recited in claim 1, wherein the transmission device comprises:
   a power source;
   a sensor arranged to determine an extent that the force indicator tab is displaced; and,
   a transmitter arranged to transmit a signal indicating the extent to a remote receiver.

13. The protective helmet as recited in claim 1, further comprising a plurality of locking devices arranged between the inner and outer shells, wherein each of said plurality of locking devices includes:
   a first portion comprising a first plurality of teeth, the first portion connected to the second end;
   a second portion comprising a second plurality of teeth, the second portion arranged on the first outer surface, wherein the first plurality of teeth are arranged to engage the second plurality of teeth; and,
   a release device connected to the first portion, the release device is operatively arranged to release said locking device.

14. A protective helmet having multiple protective zones, comprising:
   an inner shell having a first inner surface and a first outer surface;
   an outer shell having a second inner surface and a second outer surface, said outer shell functionally attached to said inner shell;
   an elastomeric zone between said first outer surface and said second inner surface;
   a plurality of sinusoidal springs positioned in said elastomeric zone, each of the plurality of sinusoidal springs comprising:
      a first end; and,
      a second end; and,
      a transmission device, including:
      a sensor arranged to determine a location of the second end;
      a transmitter arranged to transmit a signal indicating the location; and,
      a power source.

15. The protective helmet as recited in claim 14, further comprising a plurality of piston devices arranged between the inner and outer shells, wherein each of said plurality of piston devices comprises:
   a first component connected to the second end; and,
   a second component.

16. The protective helmet as recited in claim 15, wherein the second component comprises:
   a dashpot;
   an arm including a plurality of notches, the arm slidingly engaged with the dashpot; and,
   a barrier including a plurality of doors.

17. The protective helmet as recited in claim 16, wherein the first component is a cylinder and is operatively arranged to:
   move axially along the barrier;
   pass through the plurality of doors; and,
   engage the plurality of notches.

18. The protective helmet as recited in claim 14, further comprising a plurality of brackets connected to said first outer surface, said second inner surface, or both said first outer surface and said second inner surface, wherein said plurality of brackets are operatively arranged adjacent to said plurality of sinusoidal springs to limit with a lateral and torsional movement of said plurality of sinusoidal springs.

19. The protective helmet as recited in claim 14, wherein:

the sensor is arranged to determine an extent of displacement of the second end; and, the transmitter is arranged to transmit a signal indicating the extent to the remote receiver.

20. A protective helmet having multiple protective zones, comprising:

an inner shell having a first inner surface and a first outer surface;

an outer shell having a second inner surface, a second outer surface, and at least one window defined by said outer shell, said outer shell functionally attached to said inner shell;

an elastomeric zone between said first outer surface and said second inner surface;

a plurality of sinusoidal springs positioned in said elastomeric zone, each of the plurality of sinusoidal springs comprising:

a first end; and, a second end;

a plurality of piston devices arranged between the inner and outer shells, wherein each of said plurality of piston devices comprises:

a first component connected to the second end; and, a second component; and, a force indicator tab in operative contact with said second end of at least one of said plurality of sinusoidal springs, wherein said force indicator tab is moved to said at least one window by said second end when said helmet is impacted with sufficient force; and, a transmission device.

* * * * *